US005080085A

United States Patent [19]

Lovato

[11] Patent Number: 5,080,085

[45] Date of Patent: Jan. 14, 1992

[54] MACHINE FOR CUTTING GRANITE BLOCK OR STONE MATERIALS INTO SLABS

[76] Inventor: Dionigio Lovato, 6, Via Lazio, Chiampo (Vicenza), Italy

[21] Appl. No.: 365,788

[22] Filed: Jun. 14, 1989

[51] Int. Cl.[5] ..... B28D 1/08

[52] U.S. Cl. ..... 125/21; 125/16.01

[58] Field of Search ..... 125/16.01, 16.03, 16.04, 125/21

[56] References Cited

FOREIGN PATENT DOCUMENTS

| | | | |
|---|---|---|---|
| 518164 | 3/1953 | Belgium . | |
| 3823782 | 2/1989 | Fed. Rep. of Germany . | |
| 1241807 | 8/1960 | France | 125/21 |
| 2457755 | 5/1980 | France . | |
| 1014333 | 12/1965 | United Kingdom . | |

*Primary Examiner*—M. Rachuba

*Attorney, Agent, or Firm*—Birch, Stewart, Kolasch & Birch

[57] ABSTRACT

According to the invention a machine is obtained, which is particularly suited for the cutting of blocks of granite (42), wherein the chain-guiding blade (13) with its corresponding chain (75) and a block of granite (42) which is to be cut into slabs roll in a relative motion without skidding.

The place described by the centers of instantaneous rotation (41) is a horizontal line coinciding with the cutting profile (100).

The relative non-skidding rolling motion is conveyed to the chain-guiding blade (13) in one embodiment, while in another embodiment it is conveyed to the block of granite (42) which is being cut.

In order to convey the motion to the chain-guiding blade (13) or to the block of granite (42), there is a mechanical driving mechanism with a template (26) matching a counter-template (6, 81), or hydraulic devices using cylinders (19, 21) with a control device (97), comprising directional valves and proportional valves, or an electro-mechanical mechanism using electric motors with variable speed (63, 64) and racks (51, 52).

8 Claims, 4 Drawing Sheets

MACHINE FOR CUTTING GRANITE BLOCK OR STONE MATERIALS INTO SLABS

BACKGROUND OF THE INVENTION

The present invention concerns a machine for cutting granite blocks or stone materials into slabs.

Some machines are known, exploiting different methods to cut granite into slabs.

A known type of machine uses a frame consisting of a variable number of vertically arranged steel blades which are parallel to one another and spaced from one another at a distance corresponding to the thickness of the slab to be obtained. Such blades are transversally connected with each other at their ends, so as to form a rigid structure.

The frame is driven so as to have a horizontal pendular working motion and a vertical descending sliding motion during which a paste consisting of iron or cast-iron grit mixed with water and lime is introduced at the contact point between the granite and the blade, so that it exerts its abrasive action.

This solution presents the inconvenience of causing considerable wear of the blades and of allowing very low feeding speeds in the range of 2 cm/h on a cutting width of approx. 3.5 m.

Another known method, which allows higher feeding speeds, performs the cutting action by means of a large steel disc with a diameter of up to 3.5 m on the periphery of which some diamond bits are attached.

The disc, which is driven by a powerful motor, performs a working motion by rotating around its axis and by a horizontal feeding motion in the direction of the length of the cut to be made. Although this cutting method allows good feeding speeds in the range of 20 cm/h, it presents some inconveniences.

A first inconvenience arises from the remarkably high costs of the disc and of the driving assembly. Another inconvenience is that the maximum height of the cut that can be made corresponds to the radius of the diamond disc minus the radial dimension of the flange for the attachment of the driving assembly.

Another cutting method uses a steel wire covered with an elastic diamond mixture.

The wire is made to slide on a vertical plane by means of a motor and two pulleys which rotate around horizontal axes and which are parallel to each other, one pulley being connected with the motor, while the other is idle and functions as a transmission.

Thus the working motion is transmitted to the diamond wire, while suitable means transmit to the pulleys a vertical downward motion, so as to impress to the diamond wire the feeding motion. The adjustment of the distance between the pulleys allows the adjustment of the width of the cut to be made.

This method also presents some inconveniences, such as the high stress exerted by the wire on the granite, since, during the working process, it slides on the entire cutting length. Moreover, the wire does not wear out evenly on the entire periphery, but only in the area which comes into contact with the granite to be cut. In any case, the main inconvenience is represented by the side skid of the diamond wire from the vertical plane during its downward feeding motion, which causes a poor superficial quality of the cut granite slabs.

Yet another machine is known, by means of which the abovementioned inconveniences are eliminated.

This machine consists of a portal-shaped structure on which there is a chain-guiding blade supporting a chain with diamond bits. The chain-guiding blade performs a downward vertical feeding motion, during which it also performs a series of pendular motions, while maintaining the co-planarity with the descending vertical plane. The chain with diamond bits, on the other hand, is driven so as to perform the working motion, consisting of a continuous rotation around the chain-support, which acts as a guide.

However, an inconvenience presented by this type of machine arises from the fact that the line of the cut is not straight.

The present invention has the purpose of eliminating all of the above-mentioned inconveniences.

The main proposed purpose is to obtain a machine wherein the cutting line is straight and horizontal during the entire working phase.

Another proposed purpose is to obtain a machine wherein the relative motion between the chain-guiding blade and the block to be cut is pendular.

Not the least proposed purpose is to obtain a machine according to the present invention costing remarkably less than the machines of the known types.

All the above-listed purposes and others, which will be better explained hereafter are reached by means of a machine for the cutting of granite or stone materials in general into slabs, which, in accordance with the present invention, includes a portal-shaped structure, at the top of which there is a chain, preferably with diamond bits, supported by a chain-guiding blade, around which it is stretched, following the same profile, the chain-guiding blade presenting at each end a threaded lead nut connected with a vertical threaded shaft, which is rigidly mounted on the post of the portal, the machine being characterized in that the chainguiding blade with its corresponding chain and the cut surface of the granite block which is being cut roll with a relative motion without skidding, since the space described by the centers of instantaneous rotation is a line coinciding with the profile of the cut.

SUMMARY OF THE INVENTION

According to an embodiment of the present invention, the relative rolling between the chain-guiding blade and the block of granite is achieved by driving the chain-guiding blade.

The driving motion of the chain-guiding blade occurs by means of the vertical threaded shafts connected with the lead nuts, which are at the ends of the chain-guiding blade and which are driven vertically and alternatively upwards and downwards by means of hydraulic pistons, connected with a template which rolls on a counter-template.

Another embodiment realizes the conveyance of the alternatively upwards and downwards vertical motion of the threaded shafts by means of hydraulic pistons complete with proportional valves and directional ones.

Another embodiment conveys the alternate upwards and downwards vertical motion of the threaded shafts by means of electric motors with variable speed and with a rack-and-pinion coupling at the ends of the threaded shafts.

According to a varied embodiment of the present invention, the relative rolling motion between the chain-guiding blade with its chain and the block of granite, which is being cut, is achieved by conveying the motion to the block of granite.

In this case, the block of granite is loaded on an oscillating structure consisting of a mobile template rolling on a fixed counter-template, wherein the mobile template at the same time functions as a support for the block of granite which is being cut.

The mobile template and fixed counter-template are mounted on a trolley with wheels which rolls on tracks in order to make it easier to position the block of granite under the cutting blade.

Advantageously, according to the invention, both the chain with the chain-guiding blade and the block of granite have a continuous relative pendular motion from right to left and from left to right, so that, instant by instant, only a few teeth of the chain are engaged with the block to be cut. Thus, by limiting to a rather short stretch the contact area between the chain and the block, it is possible to build machines with lighter structures requiring less installed power, the specific power conveyed to the material to be cut remaining the same.

A consequence of what has been said, is the further advantage of building machines at decreased manufacturing and operation costs.

Further scope of the applicability of the present invention will become apparent from the detailed description given hereinafter and from the enclosed drawings. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
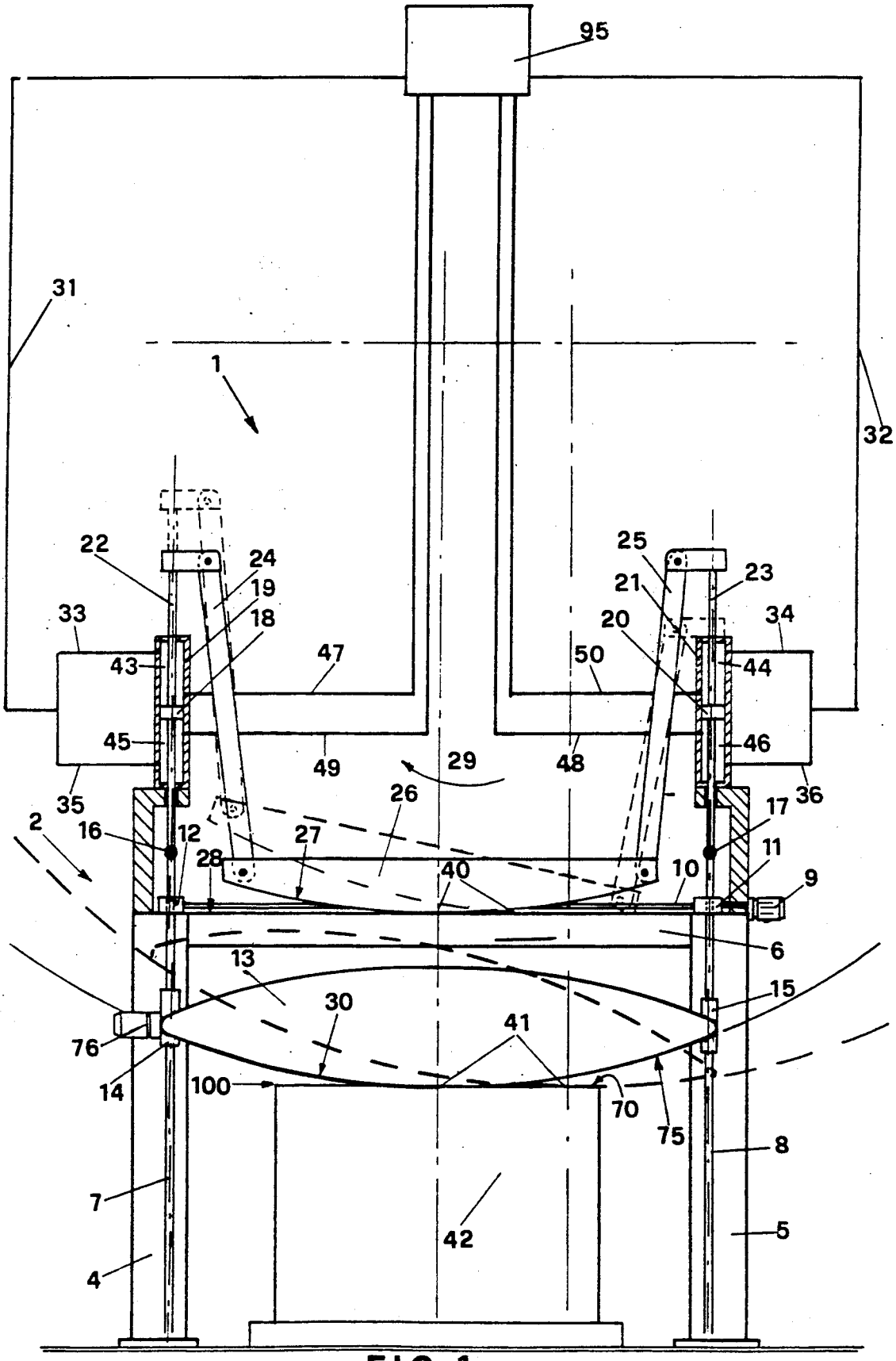
FIG. 1 illustrates a front view of the machine according to the present invention.

With reference to the mentioned figures, the machine, which is indicated as a whole with numeral 1 in FIG. 1, consists of a portal 2, comprising the posts 4 and 5, which are joined together in their upper part by the horizontal beam 6.

Within the posts 4 and 5 there are the vertical, threaded, grooved shafts 7 and 8 which are made to rotate by the geared motor 9 through the transmission shaft 10, which causes the rotation of the angular trasmission gears 11 and 12, which are respectively connected at the ends of the threaded, grooved shafts 7 and 8.

The angular transmission gear 11 consists of a bevel-gear pair (not represented in the drawing), wherein the bevel gear receiving the motion from the transmission shaft 10 engages the second bevel gear, which, in turn, is connected with the threaded grooved shaft 8 by means of a key.

Thus, a fixed sliding connection is obtained between the transmission gear 11 and the threaded, grooved shaft 8, wherein the latter receives its rotating motion from the transmission gear 11 and, at the same time, can slide vertically within the transmission gear.

An analogous situation occurs for the vertical, threaded, grooved shaft 7 and its corresponding transmission gear 12.

The chain-guiding blade 13, supporting chain 75, has at its ends the lead nuts 14 and 15, which are connected with the threaded shafts 7 and 8 respectively. Therefore, during their rotation, the threaded shafts 7 and 8 rigidly pull the chain-guiding blade 13 upwards or downwards according to the direction of rotation conveyed to them by the geared motor 9.

Moreover, in correspondence with the lead nut 14 there is the geared motor 76, which is connected with chain 75 and which conveys to it the working motion, consisting of its rotation around the chain-guiding blade 13.

Each of upper ends of the threaded shafts 7 and 8 present a ball-and-socket joint 16 and 17 respectively, by means of which each is connected with a hydraulic piston.

More specifically the ball-and-socket joint 16 connects the threaded shaft 7 with the piston 18 having a double shaft-protrusion, which slides vertically within the hydraulic cylinder 19, while the ball-and-socket joint 17 connects shaft 8 with piston 20, having a double shaft-protrusion, which slides vertically within the hydraulic cylinder 21. The ball-and-socket joints 16 and 17 have the task of conveying to the pistons 18 and 19, which are connected with them, only the vertical upward or downward movement of the shafts 7 and 8, but not their rotational movement.

The upper protruding ends 22 and 23 of the pistons 18 and 20 respectively are connected throught the bars 24 and 25 with the ends of template 26, presenting an arch-shaped profile 27 having the shape of an arc of a circle. Template 26 rolls without skidding on the flat horizontal surface 28 of beam 6, which also functions as a counter-template.

The operation of machine 1, represented in FIG. 1, occurs by sending oil under pressure into the cylinders 19 and 21 according to pre-established cyclic sequences, which are controlled by the pumping and controlling hydraulic power pack, which also in FIG. 1 has been diagrammatically represented and indicated by element 95.

The pumping hydraulic power pack 95 establishes the pressure of the oil contained in the ducts 31 and 32 and, through the control of suitable valves inserted in the circuit and not represented in FIG. 1, it sends the oil, for instance, into chamber 44, through duct 34 and into chamber 45 through duct 35. The force of the oil under pressure on piston 20 causes bar 25 to move downwards, while the action of piston 18 causes bar 24 to move upwards, so that template 26 rolls in the direction indicated with arrow 29.

In order for this to occur, an electronic control system of the hydraulic power pack 95 must open the outlet openings 48 of chamber 46 and 47 of chamber 43, thus allowing the outpouring of the oil contained therein, which flows back into the tank of the hydraulic power pack 95.

When the pistons 20 and 18 have reached the end of their stroke, the electronic control device which is present in the hydraulic power pack 95 inverts the flows, so as to set under pressure the chambers 43 through duct 33 and 46 through duct 36, obviously after shutting off the outlet openings 47 and 48 and opening the outlet openings 49 and 50. By doing this, template 26 moves in the direction opposite to the preceding one, i.e. it rolls in the direction opposite to arrow 29, performing a non-skidding rolling motion on the flat horizontal surface 28 of the counter-template 6.

Since template 26 is connected through the bars 24 and 25 with the ends 22 and 23 of the pistons 18 and 20, and these in turn are connected through the ball-and-socket joints 16 and 17 with the threaded shafts 7 and 8, for each displacement of template 26 there will be a corresponding vertical displacement of the threaded shafts 7 and 8 and, as a consequence, a rigid displacement of the chain-guiding blade 13. As has already been pointed out, the latter is in fact equipped at its ends with the lead-nuts 14 and 15 connected with the threads of the shafts 7 and 8.

The chain-guiding blade 13 presents an arch-shaped profile 30, which is the same as the profile 27 of template 26 and corresponds to an arc of a circle having the same radius.

Since template 26 performs a non-skidding rotation on the horizontal surface 28 of the counter-template 6, the geometric space formed by its centers of istantaneous rotation 40 is a horizontal straight line lying on the horizontal surface 28 of the counter-template 6, which, therefore, constitutes the fixed polar. As a consequence thereof, since profile 30 of the chain-supporting blade 13 is equal to profile 27 of template 26 and since the chain-guiding blade 13 and template 26 are rigidly joined together, and perform a rigid motion, profile 30 of the chain-guiding blade 13 performs a non-skidding rolling motion on the granite block 42. Its centers of instantaneous rotation 41 describe, therefore, a geometric place of the points, which on the block of granite 42, which is being cut, constitutes the horizontal cutting line 100. In order for the block of granite 42 to be cut, it is necessary that together with the vertical upward and downward pendular motions, also the continuous downward vertical feeding motion be conveyed to the chain-guiding blade 13 by means of the geared motor 9 and the threaded shafts 7 and 8.

Moreover, chain 75 is driven by the action of the geared motor 76 to perform its working motion consisting of its rotation around the chain-guiding blade 13.

Figure 2:
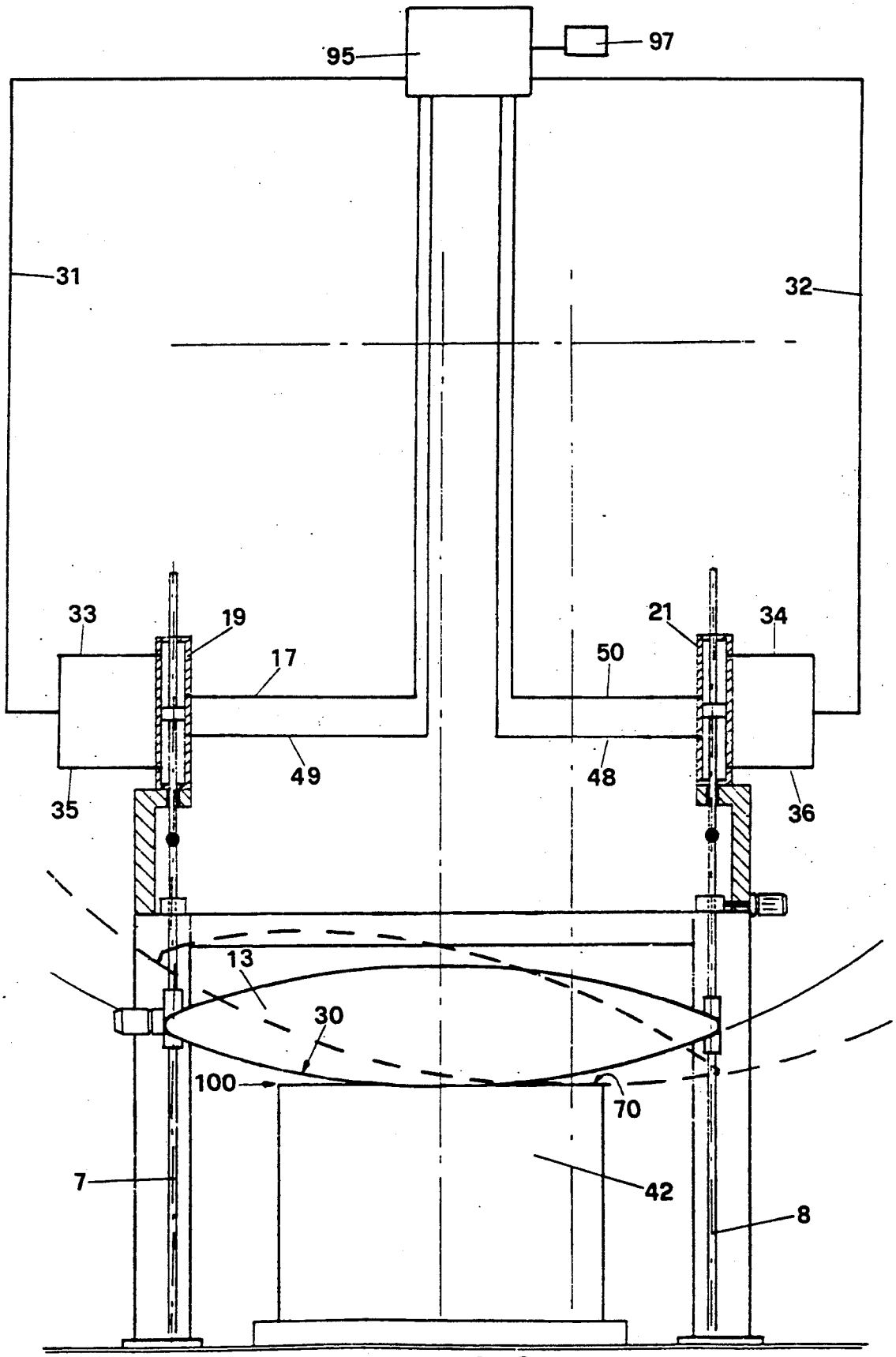
FIG. 2 illustrates another embodiment of the machine according to the present invention.

Another embodiment of the present invention is represented in FIG. 2, which differs from the preceding one represented in FIG. 1, because there is no template 26 connected with the pistons 18 and 20.

In fact, in this embodiment the non-skidding rolling motion of profile 30 of the chain-guiding blade 13 on the block of granite 42 which is being cut, is completely driven by a hydraulic system. In fact this embodiment uses a control device 97 which through directional valves and proportional valves (not represented in the drawing) convey the flow of the liquid under pressure from the hydraulic power pack 95 to the cylinder chambers 19 and 21 thereby causing the alternate raising and lowering of the threaded shafts 7 and 8.

It is interesting to observe the substantial difference between the method of performance of this embodiment as compared to the method of performance of the previously described embodiment.

In fact, in the previously described method it was sufficient to alternatively introduce the oil under pressure into the chambers of the cylinders 19 and 21, since it was the task of template 26 to copy the non-skidding rolling motion of its profile 27 with the matching profile 28 of its counter-template 6 and to transmit it to the chain-guiding blade 13, so that the latter could reproduce it in the block of granite 42 to be cut, in order to generate the horizontal cutting line 100. In the present embodiment, on the contrary, it is the task of the control device 97, by means of directional valves and of proportional valves, to adequately convey the flow of oil entering into and going out of the chambers of the cylinders 19 and 21, so as to directly cause on the non-skidding rolling motion of profile 30 of chain-guiding blade 13 to cut the block of granite 42, in order to produce the same result, i.e. a horizontal cutting line 100.

Figure 3:
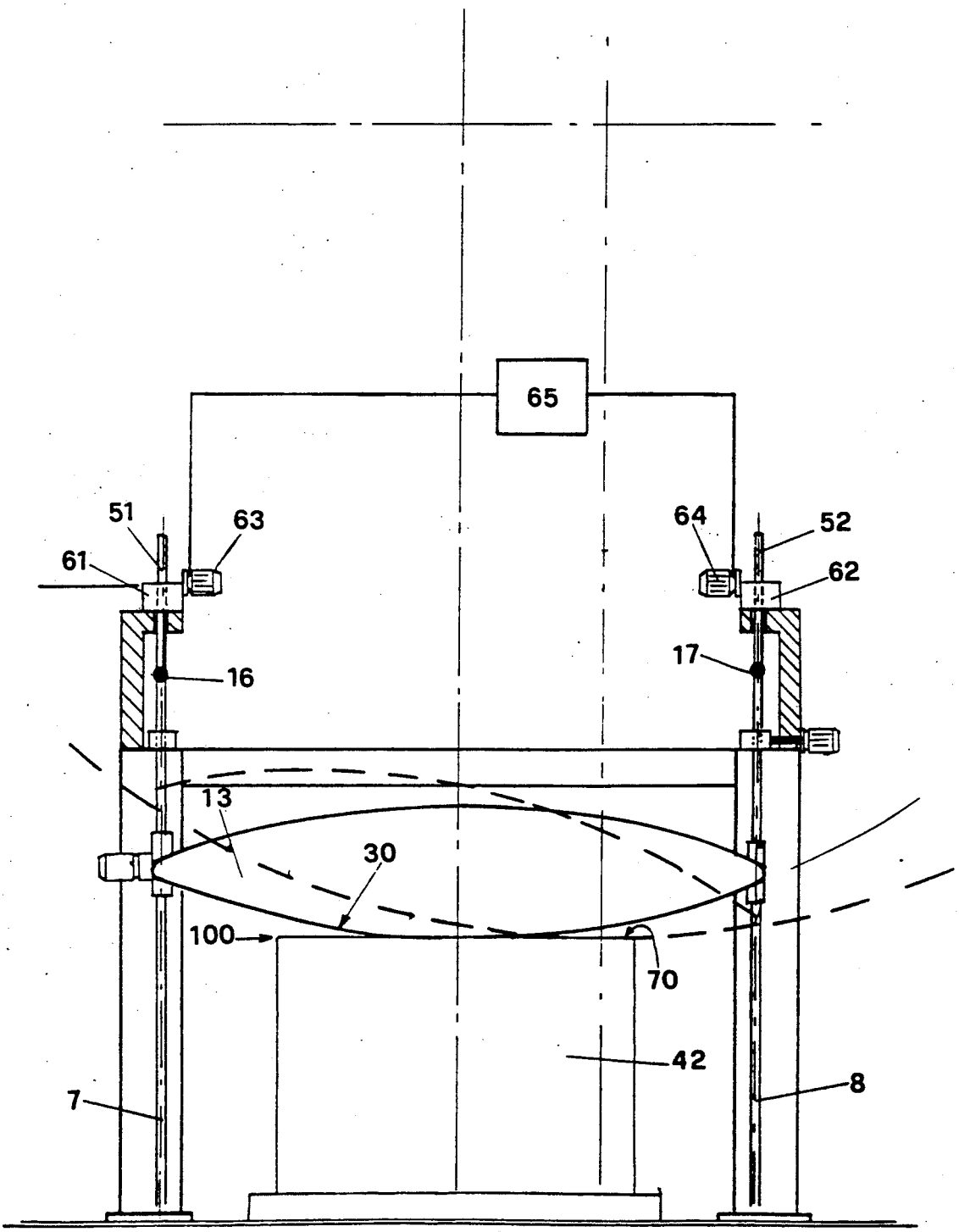
FIG. 3 illustrates another embodiment of the machine according to the present invention.

Another embodiment of the present invention is represented in FIG. 3, wherein, in this case, too, the non-skidding rolling motion of profile 30 of the chain-supporting blade 13 on the block of granite 42 is obtained without the use of template 26.

In this embodiment, in fact, the upper ends of the threaded shafts 7 and 8 consist of the racks 51 and 52, each of which is connected with the corresponding threaded shaft by means of a ball-and-socket joint 16 and 17 respectively.

The lifting and lowering of the threaded shaft 7 occurs by means of the transmission assembly 61, consisting of a pinion (not represented in the drawing) which engages rack 51 and is driven by motor 63. Similarly, the lifting and lowering of the threaded shaft 8 occurs by means of the transmission assembly 62 engaging rack 52 and driven by motor 64. The motors 63 and 64 have variable speeds and the variation of their number of revolutions is controlled by an electronic adjusting system, diagrammatically represented at 65.

In this embodiment, too, the assembly 65 must adjust the tensions conveyed to the motors 63 and 64 so as to convey, through the lifting and lowering of the racks 51 and 52, the non-skidding rolling motion directly to the profile 30 on the block of granite 42, so as to make it possible to obtain the same result, i.e. the horizontal cutting line 100.

An embodiment of the present invention, differing from the just described one, conveys the vertical pendular motion to the block of granite 42 which is being cut, instead of to the chain-guiding blade 13. Surface 70 of the block of granite 42 rolls without skidding on the surface of profile 30 of the chain-guiding blade 13.

Figure 4:
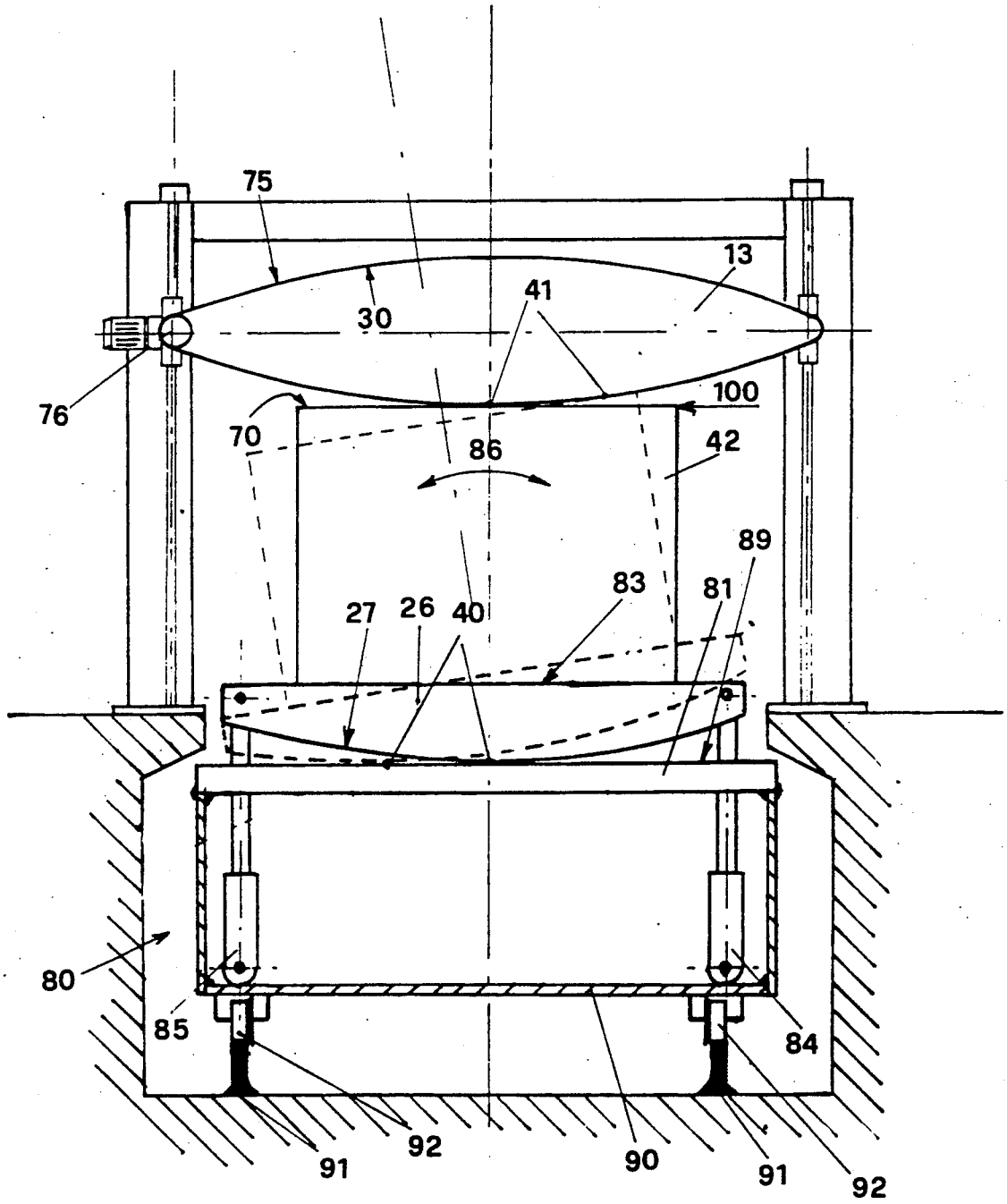
FIG. 4 illustrates another embodiment of the machine according to the present invention.

In this embodiment represented in FIG. 4, the block of granite 42, which is to be cut, is loaded on a structure 80 consisting of a frame 90, which supports the fixed counter-template 81 and the mobile template 26. The block of granite 42 is placed on the flat surface 83 of the mobile template 26, whose arch-shaped profile 27 rolls without skidding on the flat surface 89 of the counter-template 81. In this case, too, profile 27 is a profile in the shape of an arc of a circle having a radius which is equal to the radius of profile 30 of the chain-guiding blade 13.

The block of granite 42 being cut undergoes a series of pendular motions in the directions indicated by arrow 86, which progressively bring its surface 70 under the cutting action of chain 75 applied on the chain-guiding blade 13. These pendular motions can be produced, for example, by hydraulic pistons 84 and 85.

In this case the place of the centers of instantaneous rotation of the block of granite 42 is the horizontal, straight-line profile of surface 89. Since profile 30 of blade 13 is equal to profile 27 of template 26, it follows that the cutting profile 100 obtained on surface 70 of the block of granite, which matches it, is also horizontal and in a straight line.

In order to make the loading and unloading operations of the machine easier, the assembly 80, which has the task of supporting and rocking the block of granite 42, can conveniently be mounted on the wheels 92, sliding on the tracks 91.

On the basis of what has been described, it can be understood that with the machine according to the invention all the proposed goals have been reached.

First of all, the main purpose, i.e. to obtain on the block of granite 42 a straight and horizontal cut 100, has been reached.

The purpose of obtaining a machine, wherein the relative pendular motion between the chain-guiding blade 13 and the block of granite 42, has also been reached, thus allowing the construction of less costly machines. In fact, since by exploiting the pendular motion of the blade or of the block of granite, which limits to a rather short stretch the contact area between the chain and the granite to be cut, it is possible to build machines with lighter structures requiring less istalled power, with the specific power transmitted to the material to be cut remaining the same. Moreover, the reduced installed power also entrains the advantage of a reduction of the operating costs.

During the manufacturing phase the invention can acquire embodiments differing from the described ones. For instance, the machine may also consist of a plurality of blades and chains arranged parallel with each other, so as to perform several cuts on the block of granite.

Variations of a constructive nature may also be applied, which will, however, not exceed the scope of the present invention.

It is obvious that the machine according to the invention, which has been described as particularly suited for the cutting of blocks of granite, can be even more advantageously used for the cutting of other stone materials, such as marble, stones or concrete.

I claim:

1. A machine for cutting stones, particularly granite, comprising:

a frame shaped as a portal, having vertical parts and a horizontal beam part;

vertical threaded shafts rigidly mounted on said vertical parts of the frame;

a chain-guiding blade having ends and an arch-shaped profile;

threaded lead nuts connected to said vertical threaded shafts, said lead nuts supporting said ends of the chain-guiding blade;

a rotatable chain stretched around said chain-guiding blade, said rotatable chain having diamond bits;

means for moving said chain-guiding blade and said chain relative to a stone to be cut, whereby said chain rolls without sliding along a surface of said stone, said rolling defining a cutting profile coincident with an instantaneous center of rotation of said chain;

said means for moving said chain-guiding blade and said chain relative to said stone comprising variable speed electric motors which turn said vertical threaded shafts thereby alternately raising and lowering said lead nuts, said electric motors being connected to said vertical threaded shafts via transmission assemblies, and said transmission assemblies having racks.

2. A machine for cutting stones, particularly granite, comprising:

a frame shaped as a portal, having vertical parts and a horizontal beam part;

vertical threaded shafts rigidly mounted on said vertical parts of the frame;

a chain-guiding blade having ends and an arch-shaped profile;

threaded lead nuts connected to said vertical threaded shafts, said lead nuts supporting said ends of the chain-guiding blade;

a rotatable chain stretched around said chain-guiding blade, said rotatable chain having diamond bits;

means for moving said chain-guiding blade and said chain relative to a stone to be cut, whereby said chain rolls without sliding along a surface of said stone, said rolling defining a cutting profile coincident with an instantaneous center of rotation of said chain;

said means for moving said chain-guiding blade and said chain relative to said stone comprising a means for imparting pendular motion to the stone to be cut;

said means for imparting pendular motion comprising:

a template having one arch-shaped profile and one straight profile, said straight profile being in contact with said stone;

a horizonal counter-template having a flat surface in contact with said arch-shaped profile of the template, the template rolling without sliding on said flat surface of the counter-template; and means for imparting rolling motion to said template.

3. The machine of claim 2, whereby said means for imparting rolling motion to said template comprises hydraulic pistons fixed to said template.

4. The machine of claim 2, whereby said means for imparting pendular motion to said stone comprises a frame which slides on tracks by means of wheels.

5. A machine for cutting stones, particularly granite, comprising:

a frame shaped as a portal, having vertical parts and a horizontal beam part;

vertical threaded shafts rigidly mounted on said vertical parts of the frame;

a chain-guiding blade having ends and a profile;

threaded lead nuts connected to said vertical threaded shafts, said lead nuts supporting said ends of the chain-guiding blade;

a rotatable chain stretched around said chain-guiding blade, said rotatable chain having diamond bits;

a template having ends and an arch-shaped profile, said template being supported by said horizontal beam, said horizontal beam working as a counter-template upon which said template rolls without sliding;

bars connected to said ends of the template;

means for moving said template, said means for moving having ends rigidly connected to said vertical threaded shafts, and opposite ends connected to said bars at said ends of the template;

said means for moving said template operating to move said ends of the template alternatively vertically, whereby movement of said template is translated into rolling of said chain-guiding blade and said chain along a stone to be cut, said rolling being accomplished without sliding, and said rolling defining a cutting profile coincident with an instantaneous center of rotation of said chain.

6. The machine of claim 5, whereby said means for moving said template comprises two hydraulic cylinders connecting said bars at the ends of the template to said vertical threaded shafts and thereby to said lead nuts.

7. The machine of any one of claims 5, 2, whereby said cutting profile defined by said center of instantaneous rotation is a straight horizontal line.

8. The machine of claim 5 or 2 whereby said arch-shaped profile of the template is an arc of a circle having a radius and said profile of the chain-guiding blade is an arc of a circle having a radius, the two radii being equal such that said chain performs a horizontal straight-line cut.

* * * * *